US006374615B1

(12) United States Patent
Zupanc et al.

(10) Patent No.: US 6,374,615 B1
(45) Date of Patent: Apr. 23, 2002

(54) LOW COST, LOW EMISSIONS NATURAL GAS COMBUSTOR

(75) Inventors: Frank J. Zupanc; Rudolph Dudebout, both of Phoenix; John J. Lipinski, Tempe; Ram Srinivasan, Chandler, all of AZ (US)

(73) Assignee: AlliedSignal, Inc, Norristown, NJ (US)

( * ) Notice: Subject to any disclaimer, the term of this patent is extended or adjusted under 35 U.S.C. 154(b) by 0 days.

(21) Appl. No.: 09/493,646

(22) Filed: Jan. 28, 2000

(51) Int. Cl.[7] ..... F02C 1/00; F02G 3/00

(52) U.S. Cl. ..... 60/748

(58) Field of Search ..... 60/737, 748, 742, 60/752, 754, 39.826, 746, 39.821

(56) References Cited

U.S. PATENT DOCUMENTS

| | | | |
|---|---|---|---|
| 4,260,367 | A | 4/1981 | Markowski et al. |
| 4,301,657 | A | 11/1981 | Penny |
| 4,653,278 | A | 3/1987 | Vinson et al. |
| 4,701,124 | A | 10/1987 | Maghon et al. |
| 4,766,721 | A | 8/1988 | Iizuka et al. |
| 4,845,940 | A | 7/1989 | Beer |
| 4,898,001 | A | 2/1990 | Kuroda |
| 4,928,481 | A | 5/1990 | Joshi et al. |
| 5,069,029 | A | 12/1991 | Kuroda et al. |
| 5,319,935 | A | 6/1994 | Toon et al. |
| 5,321,947 | A | 6/1994 | Sood et al. |
| 5,372,008 | A | 12/1994 | Sood et al. |
| 5,590,529 | A | 1/1997 | Joshi et al. |
| 5,613,363 | A | 3/1997 | Joshi et al. |
| 5,623,826 | A | 4/1997 | Ohtsuka et al. |
| 5,638,682 | A | 6/1997 | Joshi et al. |
| 5,685,139 | A | 11/1997 | Mick et al. |
| 5,713,206 | A | 2/1998 | McWhirter et al. |
| 5,761,906 | A | 6/1998 | Norster |
| 5,794,449 | A | 8/1998 | Razdan et al. |
| 5,813,232 | A | 9/1998 | Razdan et al. |
| 5,816,050 | A | 10/1998 | Sjunnesson et al. |

FOREIGN PATENT DOCUMENTS

| | | |
|---|---|---|
| EP | 0728989 A2 | 8/1996 |
| EP | 0728989 A3 | 8/1996 |
| WO | WO 96/02796 A1 | 2/1996 |

*Primary Examiner*—Charles G. Freay
*Assistant Examiner*—William H Rodriguez
(74) *Attorney, Agent, or Firm*—Ephraim Starr; Jerry Holden; Stephen A. Slusher

(57) ABSTRACT

A combustor dome for use in a combustor has an igniter mounted in a central bore. Moving outward from the bore is a concentric pilot fuel passageway. Concentric about the pilot fuel passageway is an air passageway. Lastly, concentric about the air passageway is a premix passageway. The outlets of the pilot fuel passageway, the air passageway, and the premix passageway are generally coplanar.

26 Claims, 3 Drawing Sheets

LOW COST, LOW EMISSIONS NATURAL GAS COMBUSTOR

TECHNICAL FIELD

This invention relates generally to combustors used in gas turbine engines and in particular to a low emissions combustor that burns gaseous fuel.

BACKGROUND OF THE INVENTION

Air pollution concerns worldwide have led to stricter emissions standards requiring significant reductions in gas turbine pollutant emissions for both industrial and power generation applications burning either liquid or gaseous fuel.

Sjunnesson et al, International Publication No. WO 96/02796 discloses a low-emission combustor for a gas turbine engine having an outer casing with an upstream end wall with a pilot fuel injector, a first radial flow swirler, an igniter for initiating a stable diffusion frame in a pilot zone, a second coaxial swirler, main fuel injectors, secondary air inlets, and a main combustion zone. Importantly, the pilot zone is confined radially outwardly by a surrounding wall which constitutes the radially inner confinement of an axial outlet portion of a radial vaporization channel extending from the second swirler and a third radial flow swirler is adapted to supply the secondary air in a rotary motion opposite to that of the main flow of fuel and air.

One disadvantage with having a confined or recessed pilot zone is that the walls surrounding the zone are exposed to very high temperatures and as a consequence need to be cooled. Typically, cooling air from other parts of the gas turbine engine are brought to these walls for this purpose. However, the extraction of the cooling air from the engine results in a reduction in the engine's performance, increases carbon monoxide emissions and produces inferior engine operability and starting. Another disadvantage to the combustor disclosed in the '050 patent is that it requires three radial swirlers which adds expense and complexity to the design. Prior examples of combustors, therefore, are not as economical and robust as desired for use in small power generation systems.

Accordingly, there is a need for a low emissions natural gas combustor that does not have a confined pilot zone and is a simpler and more economic design than prior combustor designs.

SUMMARY OF THE INVENTION

The present invention provides a combustor dome for use in a combustor having an igniter mounted in a central bore. Moving outward from the bore is a concentric pilot fuel passageway having an outlet with a plurality of holes for expelling the pilot fuel at an outward angle away from the igniter tip. Concentric about pilot fuel passageway is an air passageway that has an outlet with a nozzle. Lastly, concentric about the air passageway is a premix passageway. The outlets of the pilot fuel passageway, the air passageway, and the premix passageway are all approximately coplanar.

DESCRIPTION OF THE PREFERRED EMBODIMENT

Figure 1:
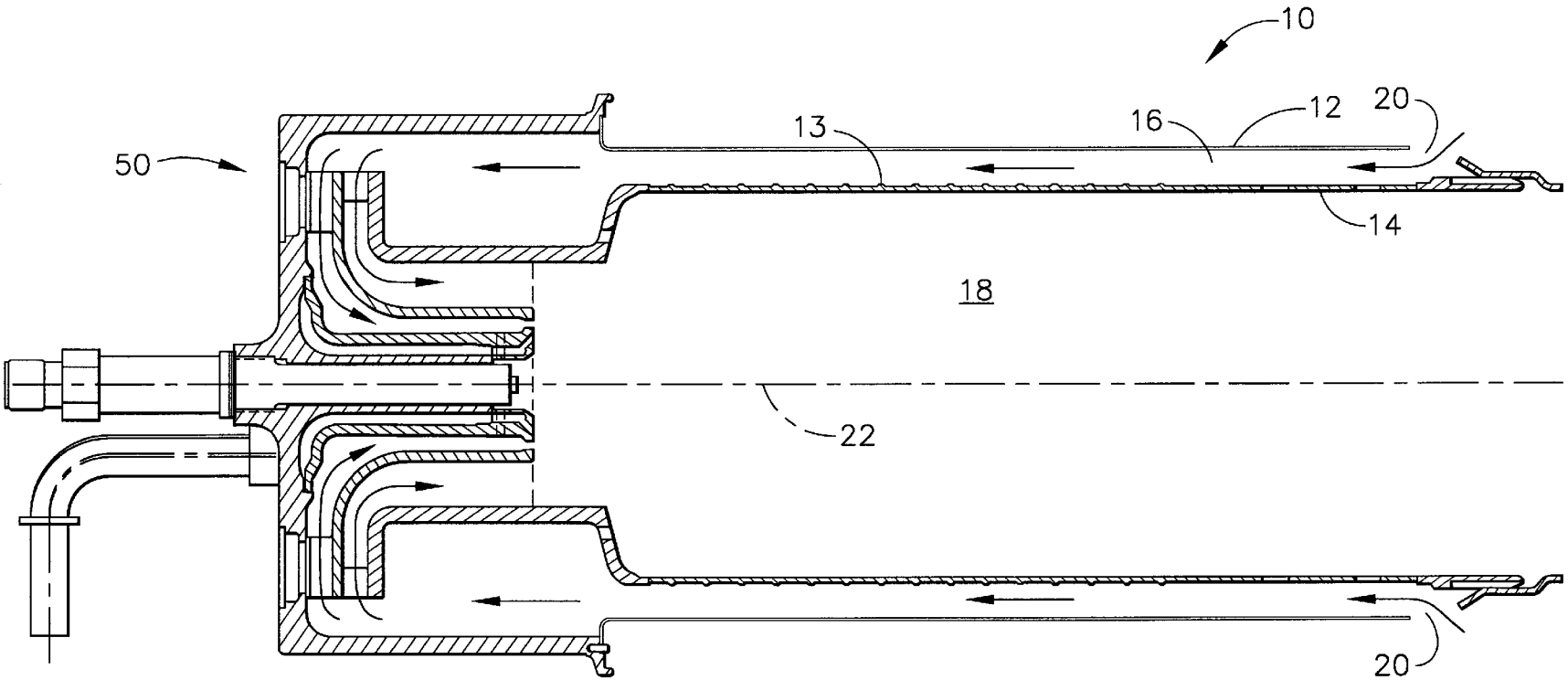
FIG. 1 is a cross-sectional view of a low emissions natural gas combustor contemplated by the present invention.

Referring to FIG. 1, a low emissions natural gas combustor is generally denoted by reference numeral 10. The combustor 10 includes an axially extending, annular heat shield 12 surrounding and radially spaced from an annular combustor liner 14 to define an air passage 16 therebetween. The combustor liner 14, in turn, defines a combustion chamber 18. It is within this chamber 18 that most of the combustion process occurs. The heat shield 12 is closed at one axial end by a dome 50. At the opposite axial end, the heat shield 12 has an open annulus 20 and a plurality of holes (not shown) through which pressurized air from a gas turbine engine enters into passage 16. The combustor 10 is symmetric about an axial centerline 22. Turbulators 13 may be mounted on the outer surface of combustor liner 14 to improve convective cooling.

Figure 2:
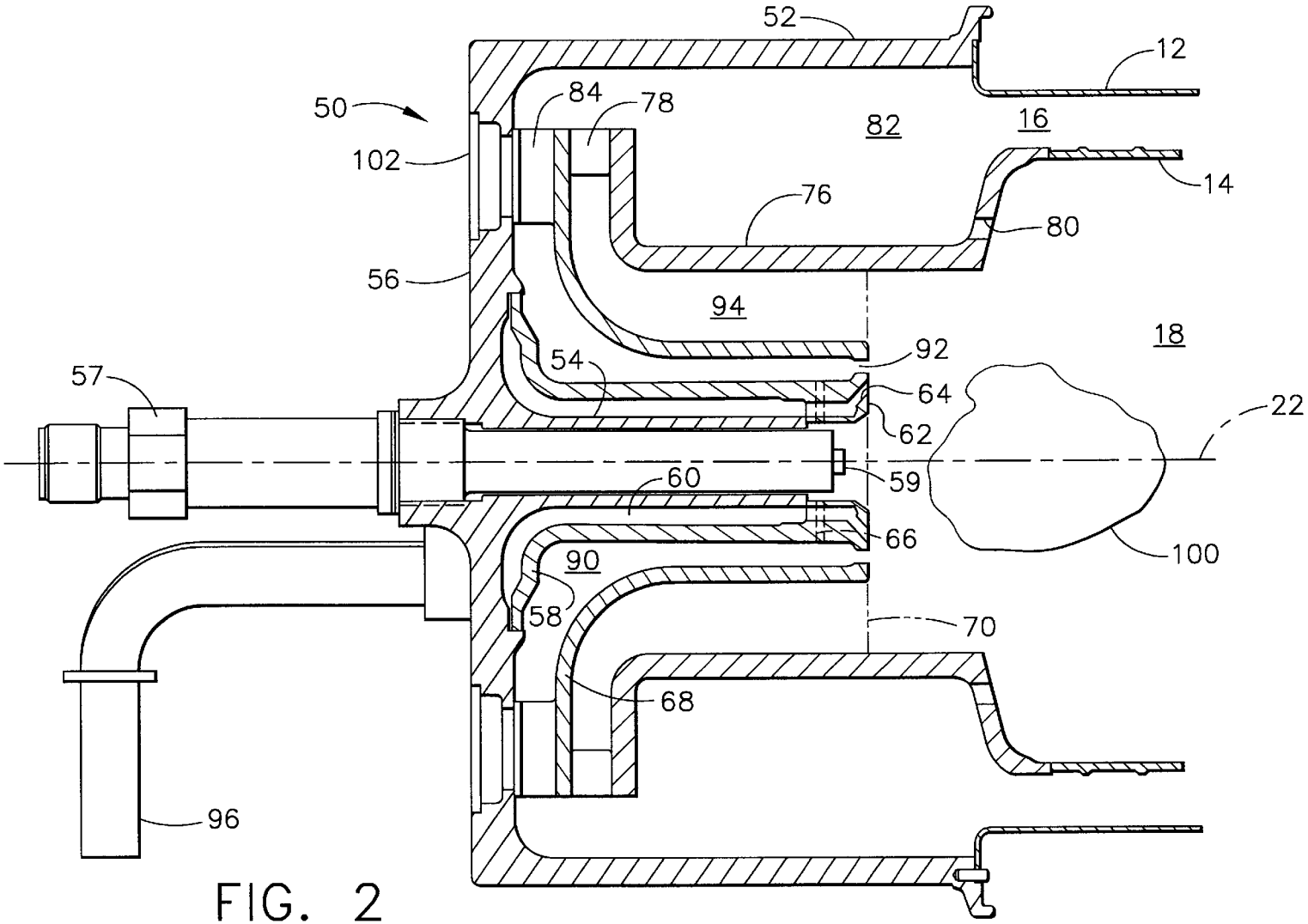
FIG. 2 is an enlarged, cross-sectional view of the dome of the combustor of FIG. 1.

Referring to FIG. 2, the dome 50 is preferably a single cast piece. Alternatively, the dome 50 can be fabricated from separate machined parts welded for tight dimensional control. The dome 50 includes an annular outer wall 52 and annular inner wall 54, and a radially extending wall 56 connecting the wall 52 to the wall 54 at one axial end. At the opposite axial end, the outer wall 52 is attached (e.g., welded, brazed and/or bolted) to the heat shield 12. The inner wall 54 defines an axial bore extending from the wall 56 toward the combustion chamber 18. An igniter 57 is mounted in the bore so that its tip 59 is aligned with the centerline 22. Coaxial about the inner wall 54 is an igniter ring 58. The ring 58 has a radial portion that is attached to radial wall 56 and an axial extending portion. This axial extending portion is radially spaced from the inner wall 54 to define a pilot fuel passage 60. At the end of the axial extending portion is a shroud 62 that connects to the inner wall 54 thereby closing the passage 60. Within the shroud 62 are a plurality of fuel holes 64 slanted at an angle so that the fuel exiting these holes moves away from the igniter tip 59 at an angle in the range of about 30 to 60 degrees relative to the center line 22. The shroud 62 also has angled air holes 66 to provide cooling air to the igniter 57.

As used herein, "extending" (in the context of one wall or other component "extending" from another) means contiguously passing, abutting, adjoining, or connecting. As used herein, "mounted" (in the context "mounted in the bore") includes removably or permanently fixed in the bore and/or relative to the bore.

Continuing with reference to FIG. 2, radially spaced and concentric with the igniter ring 58 is a premixer inner wall 68. Like the igniter ring 58, the premixer inner wall 68 has a radial portion and axial portion. Both axial portions of the igniter ring 58 and the premixer inner wall 68 end at substantially the same axial distance from a common point such as the wall 56. That is, the axial ends are substantially coplanar as the ends of both of these walls abut an imaginary radial-facing plane represented by line 70. Substantially, as used in this application, means within assembly and manufacturing tolerances acceptable to those skilled in the art. Together, the premixer inner wall 68 and the igniter ring 58 define an air passageway 90 that ends at nozzle 92. As used herein, "nozzle" means a device, component, or combination of components used to pass (either actively or passively), inject, or expel fluid. Disposed in the air passage 90 at its radial outer end is a plurality of circumferentially spaced-apart struts 84. Concentric with the premixer inner wall 68 and radially spaced therefrom is a premixer outer wall 76. The premixer outer wall 76 and inner wall 68 define a premix passageway 94. The exits of the premix passageway 94, air passageway 90 and fuel holes 64 are substantially coplanar with respect to an axial facing plane represented by dashed line 70.

The premixer outer wall 76 has an upstream radial portion connected to the radial portion of the premixer inner wall 68 by a plurality of circumferentially spaced apart radial swirler vanes 78. The premixer outer wall 76 also has an axial portion extending from the upstream radial portion to a downstream radial portion that is attached (e.g., welded, brazed and/or bolted) to the combustor liner 14. The extension of this axial portion beyond dashed line 70 improves starting and stability. The downstream radial portion has a plurality of circumferentially spaced apart, axially extending dilution air holes 80. Disposed between the premixer outer wall 76 and the dome outer wall 52 is an plenum 82 in fluid communication with air passage 16.

During the start of the gas turbine engine in which the combustor 10 is mounted, gaseous pilot fuel, such as natural gas, flows through tube 96 into pilot fuel passage 60. The term "pilot fuel" as used herein means the fuel used to initiate the combustion process. At the same time, air flows through passage 16 into plenum 82. From the plenum 82, generally unswirled air flows through passage 90 and swirled air flows through passage 94. These air flows and pilot fuel flows mix just downstream of the igniter tip 59, which ignites the air-fuel mixture to form a swirling hot gas referred to as a pilot zone, roughly represented by circle 100. The pilot zone by its presence in the combustion chamber 18 sustains the combustion process by assisting in both mixing and igniting as more air and fuel enter the chamber. It should be appreciated that during an engine start, relatively little air is likely to be available from the engine and therefore the mixture of fuel and air in the pilot zone 100 tends to be fuel rich. To avoid NOx generation, it is important to avoid high concentrations of fuel. The Applicants have found that this novel arrangement of fuel and air passages results in a more uniform fuel-to-air ratio in the pilot zone and hence lowers NOx emissions.

Figure 3:
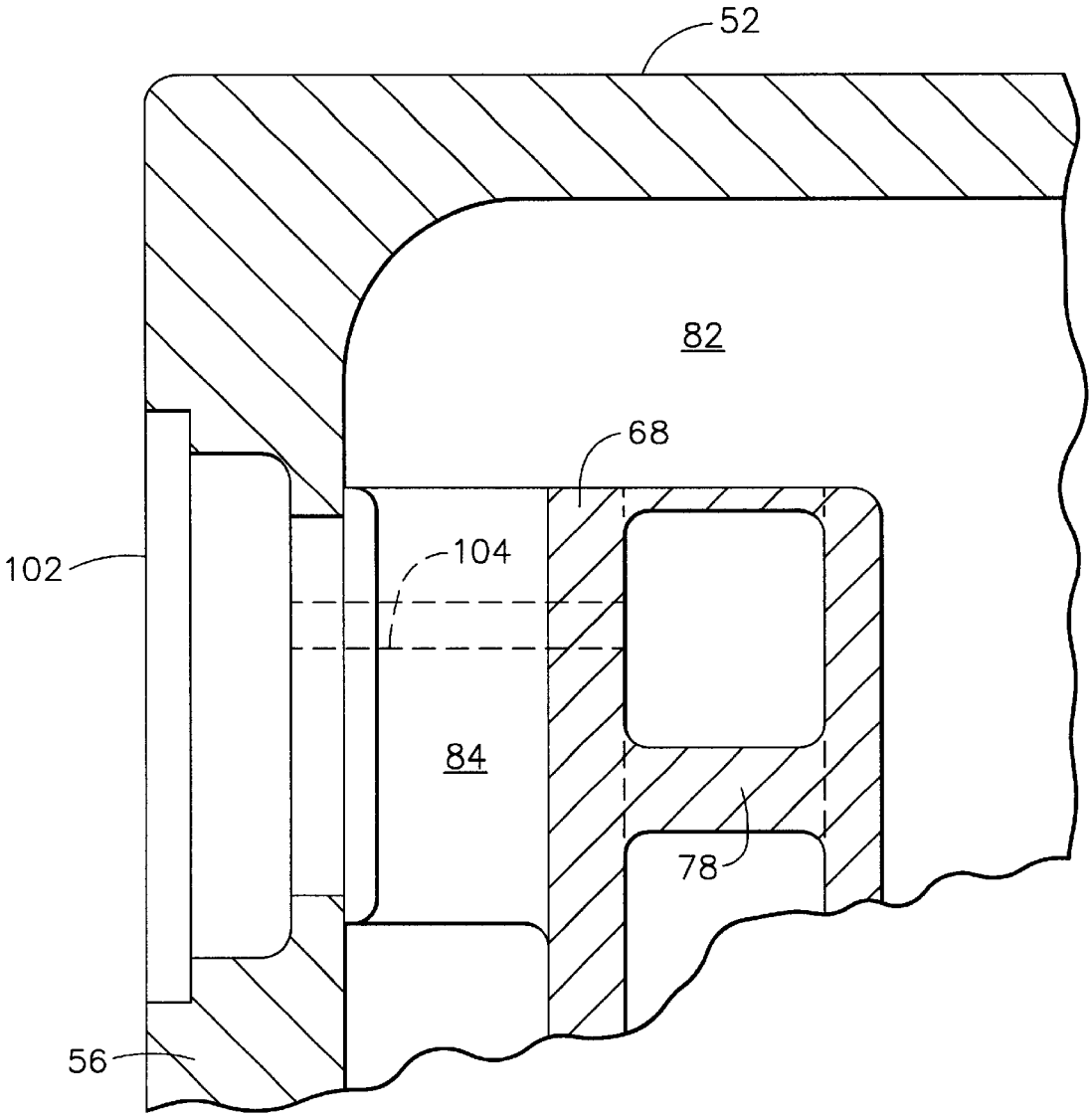
FIG. 3 is an enlarged, cross-sectional view of a portion of the combustor of FIG. 1.

Once the engine reaches above 70 to 80 percent of its operating speed, additional fuel is added through a primary fuel inlet 102. Referring to FIG. 3, the fuel entering inlet 102 flows through holes 104 in the struts 84 into the spaces between the swirler vanes 78. The fuel and air are then mixed in the premix passageway 94 so that when the mixture comes into contact with the pilot zone 100 it does not disrupt the uniformity of the mixture in the pilot zone, thus maintaining reduced NOx emissions.

Various modifications and alterations to the above-described preferred embodiment will be apparent to those skilled in the art. For example, the present invention can be used with any type of combustor and other types of fuel such as a liquid fuel. Accordingly, these descriptions of the invention should be considered exemplary and not as limiting the scope of the invention as set forth in the following claims.

What is claimed is:

1. A combustor comprising:

an annular, axially extending casing circumscribing an annular, axially extending liner to define a flow passageway therebetween, said casing having at least one aperture in fluid communication with said flow passageway to receive a flow of air, and said liner defining a combustion chamber therewithin;

a dome comprising;

an outer, axially extending wall attached at one end to said casing;

a radially extending wall extending inward from said outer wall;

an inner, axially extending wall extending from said radially facing wall to said combustion chamber, said inner wall defining a bore in which is mounted an igniter;

an igniter ring circumscribing said inner wall and spaced therefrom to define a first passageway therebetween, said igniter ring and said inner wall defining at least one aperture placing said first passageway in fluid communication with said combustion chamber at a generally coplanar location;

a second wall circumscribing said igniter ring and spaced therefrom to define a second passageway therebetween, said second passageway in fluid communication with said flow passageway, the exit of said second passageway in fluid communication with said combustion chamber at said generally coplanar location;

a third wall circumscribing said second wall and spaced therefrom to define a third passageway therebetween, said third wall and said outer wall defining therebetween a plenum in fluid communication with said flow passageway; and a first fuel inlet to said dome for delivering fuel to said first passageway.

2. The combustor of claim 1 wherein said third wall extends axially beyond said second wall into the combustion chamber.

3. The combustor of claim 2 wherein said third wall has a plurality of axially extending dilution holes.

4. The combustor of claim 1 wherein said at least one aperture defined by said igniter ring and said inner wall comprises a plurality of holes angled outward relative to an axial centerline of said combustor.

5. The combustor of claim 4 wherein said angle is between 30 and 60 degrees.

6. The combustor of claim 5 further including at least one open-ended conduit extending from said second passageway, facing generally radially inward and terminating adjacent the downstream end of said igniter.

7. The combustor of claim 1 wherein the ends of said igniter ring and said second wall cooperatively define a nozzle disposed at the exit of said second passageway.

8. The combustor of claim 2 further comprising a plenum for receiving a flow of air from said flow passageway and delivering said flow to the inlets of said second and third passageways.

9. The combustor of claim 8 further comprising a plurality of circumferentially disposed struts mounted in the vicinity of the inlet of said second passageway.

10. The combustor of claim 9 further comprising a plurality of circumferentially disposed radial swirler vanes mounted in the vicinity of the inlet of said third passageway.

11. The combustor of claim 10 wherein at least one of said struts has a fuel passageway for delivering fuel from a second fuel inlet in said dome to said third passageway.

12. The combustor of claim 11 wherein said fuel is delivered between adjacent radial swirler vanes.

13. The combustor of claim 12 wherein said third passageway is adapted to mix said swirled air from said swirler vanes with said fuel from said second fuel inlet.

14. The combustor of claim 13 wherein said first passageway receives pilot fuel flow.

15. A combustor dome comprising;

an outer annular wall, an inner annular wall defining a bore for receiving an igniter, and a third wall connecting said outer and inner walls to define a cavity therebetween;

a plurality of additional walls disposed within said cavity, said plurality of walls arranged to define:

a pilot fuel passageway circumscribing said bore and extending from a first inlet receiving pilot fuel flow to a first outlet;

an air passageway circumscribing said pilot fuel passageway and extending from a second inlet receiving air to a second outlet substantially coplanar with said first outlet; and a premix passageway circumscribing said air passageway and extending from a third inlet adapted to receive both air and fuel to a third outlet, an outer wall of said premix passageway axially extending beyond said air passageway.

16. The combustor dome of claim 15 wherein said first outlet comprises a plurality of holes angled outward relative to an axial centerline of said dome.

17. The combustor dome of claim 16 wherein said angle is between 30 and 60 degrees.

18. The combustor dome of claim 15 wherein said second outlet includes a nozzle.

19. The combustor dome of claim 15 further comprising a plenum in fluid communication with said second and third inlets.

20. The combustor dome of claim 15 wherein said second inlet includes a plurality of circumferentially disposed struts.

21. The combustor dome of claim 20 wherein said third inlet includes a plurality of circumferentially disposed radial swirler vanes.

22. The combustor dome of claim 21 wherein at least one of said struts has a fuel passageway for delivering fuel from a second fuel inlet in said dome to a space between adjacent radial swirler vanes.

23. The combustor dome of claim 15 wherein each of said plurality of walls has a radial extending portion and an axial extending portion.

24. The combustor dome of claim 15, further compromising a plurality of radially extending holes in said inner wall of said air passageway.

25. The combustor dome of claim 19, further compromising a plurality of dilution holes extending axially from said plenum through said outer wall of said premix passageway.

26. A combustor dome comprising;

an outer annular wall, an inner annular wall defining a bore for receiving an igniter, and a third wall connecting said outer and inner walls to define a cavity therebetween;

a plurality of additional walls disposed within said cavity, said plurality of walls arranged to define:

a pilot fuel passageway circumscribing said bore and extending from a first inlet receiving pilot fuel flow to a first outlet;

an air passageway circumscribing said pilot fuel passageway and extending from a second inlet receiving air to a second outlet substantially coplanar with said first outlet; and a premix passageway circumscribing said air passageway and extending from a third inlet to a third outlet, said third inlet adapted to receive both air and fuel.

* * * * *